US006129882A

United States Patent [19]

Haider

[11] Patent Number: 6,129,882

[45] Date of Patent: Oct. 10, 2000

[54] APPARATUS FOR MANUFACTURING MULTIFILAMENT THREADS

[75] Inventor: Bruno Haider, Gmunden, Austria

[73] Assignee: SML Maschinengesellschaft m.b.H., Austria

[21] Appl. No.: 09/266,441

[22] Filed: Mar. 11, 1999

[30] Foreign Application Priority Data

Mar. 13, 1998 [AT] Austria ..... 458/98

[51] Int. Cl.[7] ..... D02J 1/22

[52] U.S. Cl. ..... 264/290.5; 28/219; 28/244; 28/245; 264/342 RE; 425/66; 425/367; 425/377

[58] Field of Search ..... 264/290.5, 342 RE; 425/66, 367, 377; 28/219, 244, 245

[56] References Cited

U.S. PATENT DOCUMENTS 3,500,553 3/1970 Patton et al. .
4,967,457 11/1990 Beck et al. .
5,183,620 2/1993 Duncan et al. .
5,538,792 7/1996 Jacob et al. .

FOREIGN PATENT DOCUMENTS

415783 A2 3/1991 European Pat. Off. .
298767 B1 12/1992 European Pat. Off. .
726338 A2 8/1996 European Pat. Off. .
1336123 11/1973 United Kingdom .

*Primary Examiner*—Leo B. Tentoni
*Attorney, Agent, or Firm*—Samuels, Gauthier & Stevens

[57] ABSTRACT

The invention relates to an apparatus for manufacturing multifilament threads with at least one hot-air module 6 for drawing or relaxing the thread Y. To manufacture multifilaments with particularly high strength and to avoid the problems of the bearings of the rollers 9, 10 in the hot-air modules 6, at least one apparatus is provided for screening the hot stream of air from the rollers 9, 10, 10' of the or each hot-air module 6. Such apparatus may, for example, take the form of divider sheets 12. To facilitate the introduction of the thread Y into the hot-air module 6, it may be furthermore provided according to the invention that two rows of rollers 9, 10 facing each other are arranged in the or each hot-air module 6, at least the rollers 10 of one row being arranged in the direction of the rollers 9 of the other row and movable beyond these so that a meander-shaped arrangement of the thread Y can be achieved automatically in the hot-air modules 6. When the rollers 9, 10 are displaced, the divider sheets 12 or the like are folded away, displaced, or the like.

17 Claims, 3 Drawing Sheets

APPARATUS FOR MANUFACTURING MULTIFILAMENT THREADS

FIELD OF THE INVENTION

The invention relates to an apparatus for manufacturing multifilament threads with at least one hot-air module for drawing or relaxing the thread.

BACKGROUND TO THE INVENTION

The term "multifilament thread" or "multifilament" covers threads which are built up from many single so-called filaments. Those manufactured from plastics material form the starting form for industrial yarns, sewing yarns, yarns for belts, ropes or similar. Thermoplastic materials such as polypropylene, polyethylene, polyester or polyamides such as e.g. nylon are used.

One process for manufacturing a multifilament thread is described for example in the EP 0 726 338 A2. Such apparatus consist of an extruder in which granules of the starting material are melted and pressed through a spinning nozzle. Depending on the intended use, a specific number of filaments is combined into a thread and drawn off from the extruder via a system of deflector rollers. The spun thread is subsequently drawn to increase its strength. This is carried out by heated rollers rotating at different speeds. The drawing ratio is determined by the ratio of the speed of the rollers. To be able to transfer sufficient heat to the thread, the thread loops several times round a pair of rollers, a so-called "galette pair", and is then fed to a further pair of rollers. The rollers of a galette pair must have exactly equal speeds. If the final desired drawing ratio is reached, the thread is finally wound onto a bobbin roller. After this, it is processed further according to its intended use. Thus, the thread can be given an appropriate character by subsequent texturizing.

To draw the thread further, in particular for high-strength threads, it also passes through hot air modules or ovens in which the thread is heated to very high temperatures by an air blower, and is again drawn through rollers rotating at different speeds before and after the oven. In addition, such ovens can be used as a relaxation stage, whereby the thread is stabilized and has a relatively high elasticity and a low residual shrinkage. Such yarns are used for example for the manufacture of base layers for carpets where strength is less important, but the elasticity of the yarn is certainly a factor. To prevent the carpet from bulging subsequently, the carpet base must not have a high residual shrinkage.

SUMMARY OF THE INVENTION

A major problem with such hot-air modules is the temperature loading of the rollers or of the bearings of these rollers, which are arranged in the stream of air. As a result of this, the rollers or bearings must be frequently serviced.

One object of the present invention is to develop an apparatus for manufacturing multifilaments by means of which threads with particularly high strength can be manufactured without the problems of the known systems arising with regard to the bearings of the rollers in the hot-air modules.

A further object of the invention is to create an apparatus of the kind described at the beginning in which the thread can be introduced more easily and thus more quickly into the hot-air module after changing the bobbin or after the thread has broken.

The first object may be achieved by providing at least one apparatus for screening the hot stream of air from the rollers of the or each hot-air module. This means that the rollers or their bearings are subjected to substantially less heat and thus may have a longer service life and reduced maintenance cost.

According to a further feature of the invention, the or each apparatus for screening the hot stream of air is formed by a divider sheet which has slits through which the threads can pass. This represents a simple and very economical but simultaneously very efficient realization.

According to a further feature of the invention, the rollers in the hot-air module consist of aluminium and a ceramic coating. The ceramic coating prevents the hot thread from sticking.

The second object according to the invention may be achieved by arranging two rows of rollers facing each other in the or each hot-air module where at least the rollers of one row are arranged in the direction of the rollers of the other row and movable beyond them so that a meander-shaped arrangement of the thread can be achieved automatically in the hot-air module. Automatic threading means that manual handling can be dispensed with, for the most part at least, which means that bobbin changes can be carried out more quickly.

According to a further feature of the invention, at least one apparatus is provided for screening the hot stream of air from the rollers of the or each hot-air module such as, for example, a divider sheet or similar, which is constructed to be able to be moved away, for example, foldable or displaceable, to facilitate the movement of the movable rollers.

The invention further provides a method for drawing or relaxing multifilament thread comprising:

passing the multifilament thread along a path defined by a plurality of rollers;

supplying a stream of hot air to thread travelling along the path; and screening the rollers from the stream of hot air.

In the above method, the thread is generally passed along a meandering path through the apparatus. When a bobbin is to be replaced or the thread breaks, the recovery procedure generally includes the steps of displacing screening means from between the rollers, moving the rollers to a first relative position defining a straight path between them, introducing the thread between the rollers along the straight path, moving the rollers to a second relative position providing the meandering path, and returning the screening means to between the rollers.

BRIEF DESCRIPTION OF THE DRAWINGS

An embodiment of the invention will now be described, by way of example only, with reference to the accompanying drawings, in which.

DETAILED DESCRIPTION OF A PREFERRED EMBODIMENT

Figure 1:
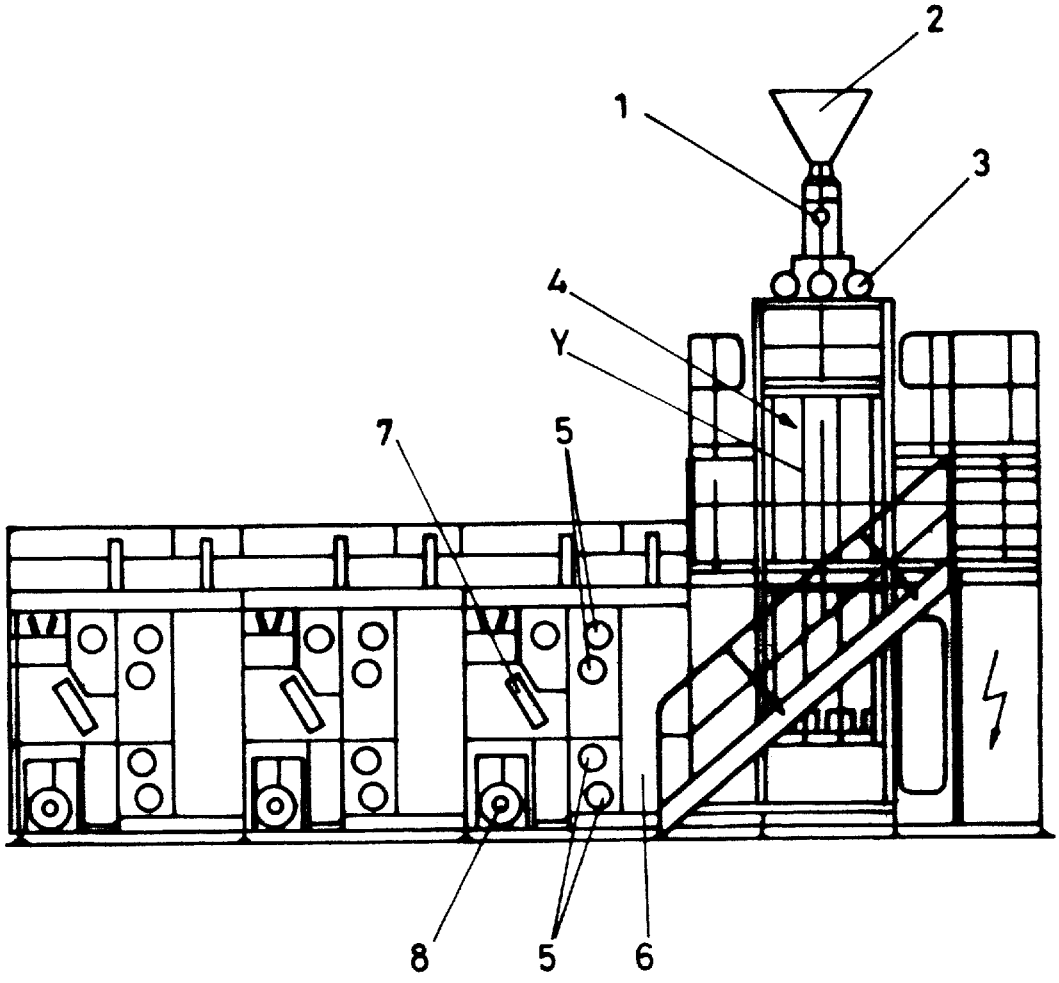
FIG. 1 is a diagrammatic view of an apparatus for manufacturing multifilament threads.

As shown diagrammatically in FIG. 1, the spinning machine consists of the extruder 1, towards which granules of a desired plastics material are fed via a funnel 2. Depending on the material used, colouring can be carried out before extruding. For example, polypropylene should be coloured before it is extruded into fibres since it cannot be coloured after extrusion. However, other materials, e.g. polyamide or polyester, can be coloured after extrusion into fibres. The spinning pump 3 pumps viscous molten plastics material through a spinning nozzle which is fitted with a suitable number of holes according to the number of filaments per thread. The filaments emerging from the spinning nozzle are treated with spinning oil in stage 4 to improve drawing of thread Y and, in addition, in addition to bring about better adhesion of the filaments to each other.

The thread Y then runs over several galette pairs 5 which are rotated at different speeds in order to draw the thread Y. To facilitate the drawing, the rollers of galette pairs 5 are heated. To improve the heat transfer, the thread Y is looped several times around the rollers of a galette pair 5. Accordingly, the rollers of a galette pair 5 must naturally have exactly the same speed.

After the galette pairs 5, the drawn thread Y optionally runs through a hot-air module 6 in which a further drawing or relaxation, in particular for high-strength threads, or only a stabilizing of the thread is carried out. The thread is then wound in a swirling step 7 at certain intervals so that a detachment of individual filaments from the thread Y is prevented or at least made difficult. Finally, thread Y is wound onto a bobbin roller 8.

In the case of a thread break, the free end of the thread Y is tied to a suction nozzle. The bobbin rollers are then changed and the thread Y is finally re-threaded by hand from the suction nozzle using threading tweezers over the galette pairs 5, over the rollers in the hot-air module 6, through the swirling step 7 and finally to the bobbin roller 8. During this manual process, the spinning pump 3 continues to deliver extruded filaments. The material is sucked off by the suction pump, however, and is not used again.

The aim is therefore to then carry out the threading process as quickly as possible and automatically. If the bobbin rollers 8 are changed correctly, a fresh threading is not necessary. In this case, the thread is drawn off with a suction pistol during the replacement.

Figure 2B:
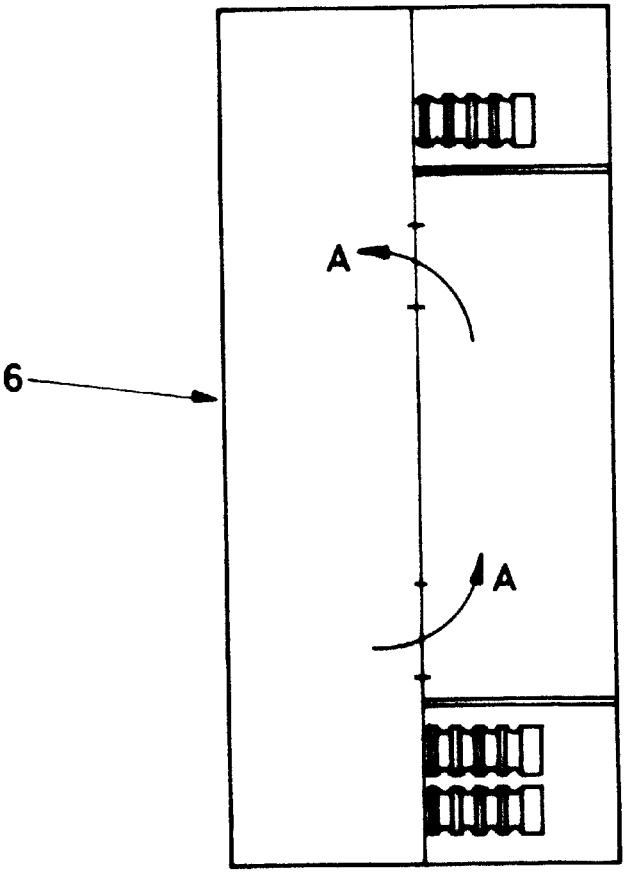
FIGS. 2*a* and 2*b* are views of a hot-air module forming part of the apparatus of FIG. 1, said module having separating sheets for screening the heated air stream from the rollers of the module.
Figure 2A:
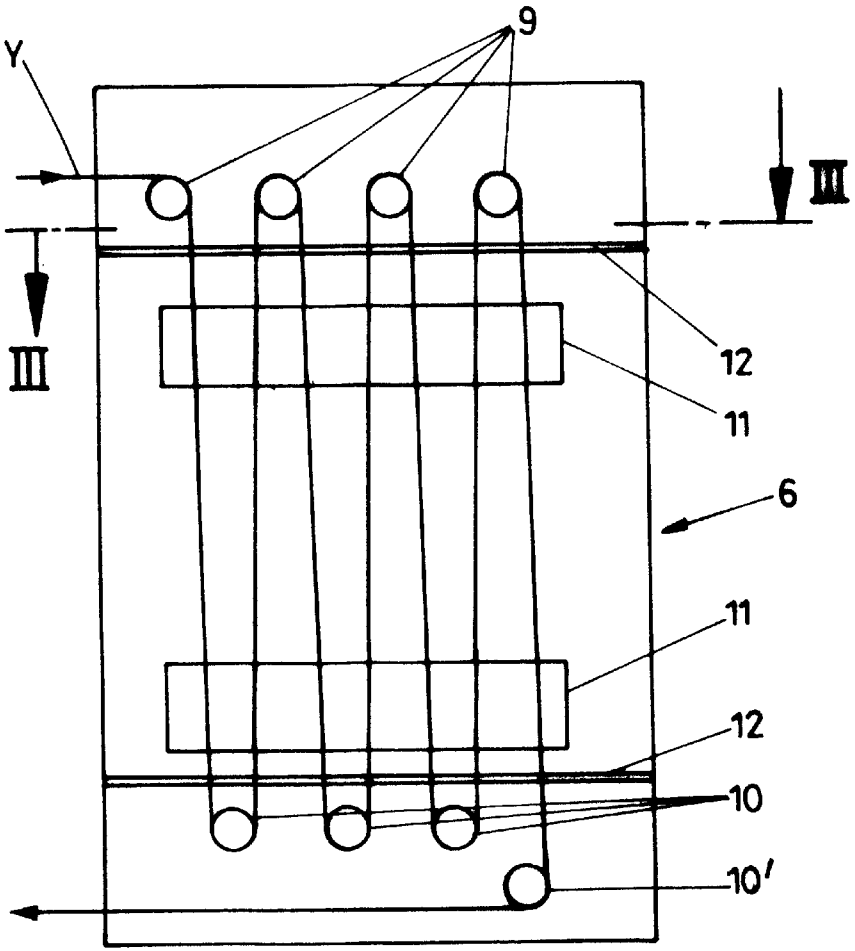

FIGS. 2*a* and 2*b* show a version of a hot-air module 6 which is constructed in the form of a closed box. The heat is conducted by a stream of air in the direction of arrow A past thread Y. To drawn thread Y as far as possible in the hot-air module 6, the thread Y, is preferably guided over two rows of rollers 9, 10 so as to take a meandering path. The greater length of the meandering path during which drawing is carried out enables heat to be transferred more effectively to thread Y. As a result, drawing of the thread Y may be improved and very high strengths may be achieved. The rollers 9, 10 are in turn coated with ceramic to prevent the thread Y from sticking. The openings 11 for the hot stream of air are provided with flaps (not shown), which are closed automatically when the door of the hot-air module 6 is opened so that the operators are protected from the heat.

To protect the rollers 9, 10 or their store from the heat of the stream of air required to heat the thread Y, divider sheets 12 are provided underneath and above the rollers 9, 10 to separate the rollers 9, 10 from the hot stream of air. The divider sheets 12 are formed with slits 13 corresponding to the number of passes of the thread Y so that the plates 12 do not block the meandering path of the thread Y. The slits 13 should be sufficiently wide to avoid contact between the thread Y and the divider sheets 12 while the machine is running and to permit the thread Y to be threaded easily. However, they should also be sufficiently narrow that there is only a limited transfer of heat from the middle area of the hot-air module 6 to the rollers 9, 10 (see FIG. 3). For example, when the apparatus is in use, the temperature reached in the vicinity of the rollers 9,10 is approx. 90–100° C., whereas the stream of air for heating the thread Y may be 180° C.

Figures 3, 4A, 4B, 4C:
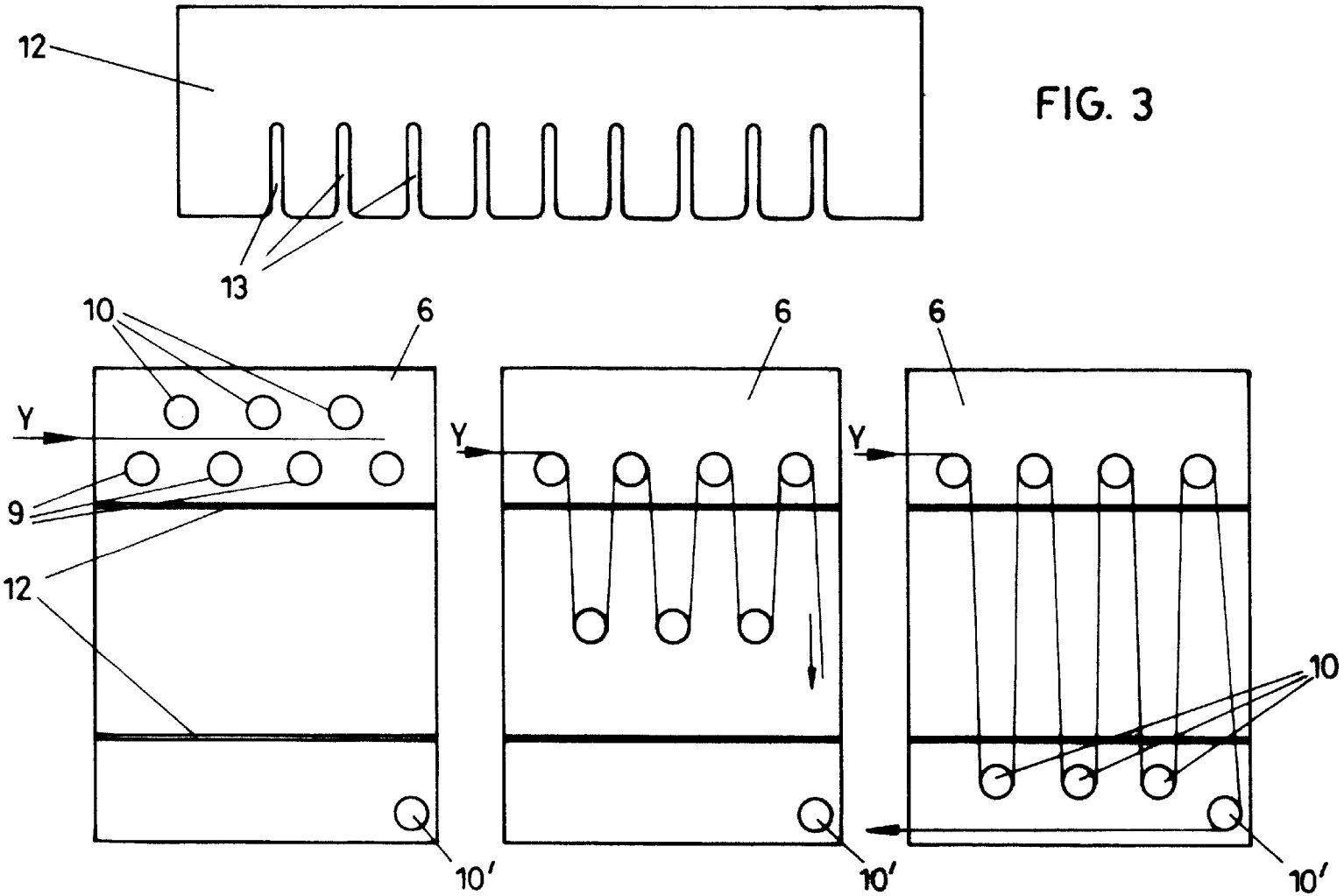
FIG. 3 is a view of the separating sheet from above.
FIGS. 4*a* to 4*c* are views of a hot-air module with displaceably arranged rollers for automatically threading the thread.

In FIGS. 4*a*–4*c*, the principle of the automatic threading in the hot-air module 6 is represented diagrammatically. If the thread Y is newly threaded in the hot-air module 6, the rollers 10 of the lower row are moved upwards according to the invention, through the rollers 9 of the upper row of rollers so that the thread Y can be threaded between the rollers 9 and 10. The rollers 10 are then moved downwards so that a meander-shaped looped path of thread Y around the rollers automatically results. The beginning of the thread Y should then simply be threaded by hand round the deflection roller 10'. This could e.g. be avoided by arranging the exit of the yarn opposite the entrance of the yarn. To permit movement of the rollers 10 between the positions shown in FIGS. 4*a* and 4*c*, the spaces between the rollers 9 must be larger than the diameters of the rollers 10. Moreover, the divider sheets 12 must be moved away from between the rollers 9, 10 during the threading operation and re-positioning them before drawing of the thread Y is re-started. This can be done by folding or displacing, for example. The automatic threading means that the whole laying of the thread can be carried out more quickly in the case of a thread break which means there is less waste and productivity can thereby be increased. Naturally, it is also conceivable to design only the rollers 9 of the upper row or the rollers 9, 10 of both the upper and the lower row as displaceable.

The present invention is not limited to the represented embodiments. In particular, the number of galette pairs 5, the rollers 9, 10 or the spinning pumps 3 can naturally vary.

What is claimed is:

1. Apparatus for drawing or relaxing multifilament thread comprising:

a plurality of rollers for defining a path for the thread through the apparatus;

means for supplying a stream of hot air to thread travelling along the path; and screening means for screening the rollers from the stream of hot air.

2. The apparatus of claim 1, wherein the screening means comprises at least one sheet having slits for passage of the thread through the sheet.

3. The apparatus of claim 1, wherein the rollers are provided in first and second rows spaced apart in a direction perpendicular to their rotational axes to define a meandering thread path through the apparatus.

4. The apparatus of claim 3, wherein the rollers of the first row are located above the rollers in the second row.

5. The apparatus of claim 4, wherein the screening means comprises first and second sheets having slits for passage of the thread through the sheet and located adjacent respective rows.

6. The apparatus of claim 5, wherein the rollers of the second row are movable between a first position to one side of the first row where the rollers define a straight path for insertion of the thread and a second position to the other side of the first row where the rollers define the meandering thread path.

7. The apparatus of claim 6, arranged so that first and second sheets having slits for passage of the thread through the sheet are positioned adjacent respective rows in said second position and are displaceable from between the rollers to permit the rollers to be moved to the first position.

8. The apparatus of claim 1, wherein the rollers are of aluminium with a ceramic coating.

9. The apparatus of claims 3, wherein the air supply means is arranged to direct the stream of hot air into the apparatus in a direction generally at right angles to the thread path and generally at right angles to the direction of travel of the thread.

10. Apparatus for manufacturing multifilament threads including extruder means for forming plastics material into a multiplicity of filaments, means for forming the filaments into thread, and apparatus for drawing or relaxing the multifilament thread comprising:

a plurality of rollers for defining a path for the thread through the apparatus;

means for supplying a stream of hot air to thread travelling along the path; and screening means for screening the rollers from the stream of hot air.

11. Apparatus for drawing or relaxing multifilament thread comprising:

a plurality of rollers for defining a path for the thread through the apparatus, wherein the rollers are provided in first and second rows spaced apart in a direction perpendicular to their rotational axes to define a meandering thread path through the apparatus;

means for supplying a stream of hot air to thread travelling along the path; and means supporting the rollers of the second row for movement between a first position to one side of the first row where the rollers define a straight path for insertion of the thread and a second position to the other side of the first row where the rollers define the meandering thread path.

12. Apparatus for manufacturing multifilament thread including extruder means for forming plastics material into a multiplicity of filaments, means for forming the filaments into thread, and apparatus for drawing or relaxing the multifilament thread, said drawing or relaxing apparatus comprising:

a plurality of rollers for defining a path for the thread through the apparatus, wherein the rollers are provided in first and second rows spaced apart in a direction perpendicular to their rotational axes to define a meandering thread path through the apparatus;

means for supplying a stream of hot air to thread travelling along the path; and means supporting the rollers of the second row for movement between a first position to one side of the first row where the rollers define a straight path for insertion of the thread and a second position to the other side of the first row where the rollers define the meandering thread path.

13. A method for drawing or relaxing multifilament thread comprising:

providing a multifilament thread;

passing the multifilament thread along a path defined by a plurality of rollers;

supplying a stream of hot air to thread travelling along the path; and screening the rollers from the stream of hot air such that the multifilament thread is drawn or relaxed.

14. The method of claim 13, wherein the rollers are screened by at least one sheet having slits for passage of the thread through the sheet.

15. The method of claim 13, wherein the thread is passed along a meandering path through the apparatus.

16. The method of claim 15, comprising the steps of displacing screening means from between the rollers, moving the rollers to a first relative position defining a straight path between them, introducing the thread between the rollers along the straight path, moving the rollers to a second relative position providing the meandering path, and returning the screening means to between the rollers.

17. The method of claim 15, wherein the temperature in the vicinity of the rollers is about 80–90 degrees C less than the temperature of the air for heating the thread.

* * * * *